US007798916B2

(12) United States Patent
Matsunaga et al.

(10) Patent No.: US 7,798,916 B2
(45) **Date of Patent: *Sep. 21, 2010**

(54) GOLF CLUB HEAD

(75) Inventors: Hideo Matsunaga, Chichibu (JP); Makoto Kubota, Tokyo (JP); Masaomi Hiruta, Tokyo (JP)

(73) Assignee: Bridgestone Sports Co., Ltd, Tokyo (JP)

( * ) Notice: Subject to any disclaimer, the term of this patent is extended or adjusted under 35 U.S.C. 154(b) by 124 days.

This patent is subject to a terminal disclaimer.

(21) Appl. No.: 12/040,979

(22) Filed: Mar. 3, 2008

(65) Prior Publication Data

US 2008/0220894 A1 Sep. 11, 2008

(30) Foreign Application Priority Data

Mar. 5, 2007 (JP) ..... 2007-054397

(51) Int. Cl.
*A63B 53/04* (2006.01)

(52) U.S. Cl. ..... 473/329; 473/342; 473/346

(58) Field of Classification Search ..... 473/324–350
See application file for complete search history.

(56) References Cited

U.S. PATENT DOCUMENTS 1,678,637 A * 7/1928 Drevitson ..... 473/330
4,988,104 A * 1/1991 Shiotani et al. ..... 473/305
5,106,094 A * 4/1992 Desbiolles et al. ..... 473/342
5,303,922 A * 4/1994 Lo ..... 473/330
5,433,440 A * 7/1995 Lin ..... 473/342
5,467,983 A * 11/1995 Chen ..... 473/342
5,522,593 A * 6/1996 Kobayashi et al. ..... 473/349
5,536,006 A * 7/1996 Shieh ..... 473/342
5,669,829 A * 9/1997 Lin ..... 473/346
5,868,635 A * 2/1999 Aizawa et al. ..... 473/324
6,071,200 A * 6/2000 Song ..... 473/345
6,200,228 B1 * 3/2001 Takeda ..... 473/324
6,224,496 B1 * 5/2001 Rowland et al. ..... 473/288
6,425,832 B2 * 7/2002 Cackett et al. ..... 473/345
6,450,896 B1 * 9/2002 Chen ..... 473/324
6,663,506 B2 * 12/2003 Nishimoto et al. ..... 473/345
6,780,124 B2 * 8/2004 Lu ..... 473/342
6,800,038 B2 * 10/2004 Willett et al. ..... 473/329
7,121,958 B2 * 10/2006 Cheng et al. ..... 473/345
7,160,204 B2 * 1/2007 Huang ..... 473/342
7,186,191 B2 * 3/2007 Chen et al. ..... 473/345

(Continued)

FOREIGN PATENT DOCUMENTS

JP 05-029563 A 4/1993

(Continued)

*Primary Examiner*—Alvin A Hunter
(74) *Attorney, Agent, or Firm*—Sughrue Mion, PLLC

(57) ABSTRACT

This invention provides a hollow metal golf club head including at least a face portion, sole portion, side portion, and crown portion. This golf club head includes a head main body having an opening in the face portion, and a face plate engaged and welded with the opening. The head main body comprises a protruding portion which forms a part of the face portion and protrudes upward from a central portion, in a toe-and-heel direction, of a corner portion between the face portion and the sole portion in the golf club head. The face plate comprises s a recessed portion which extends upward from the lower edge of the face plate and engages with the protruding portion.

9 Claims, 11 Drawing Sheets

U.S. PATENT DOCUMENTS

| | | | | |
|---|---|---|---|---|
| 7,207,898 | B2 * | 4/2007 | Rice et al. | 473/329 |
| 7,258,628 | B2 * | 8/2007 | Huang et al. | 473/342 |
| 2002/0065147 | A1 | 5/2002 | Sano | |
| 2003/0104878 | A1 | 6/2003 | Yabu | |
| 2003/0114244 | A1 | 6/2003 | Matsunaga | |
| 2003/0125131 | A1 * | 7/2003 | Nishimoto et al. | 473/345 |
| 2005/0148405 | A1 | 7/2005 | Imamoto | |
| 2008/0139338 | A1 * | 6/2008 | Matsunaga et al. | 473/346 |
| 2008/0220894 | A1 * | 9/2008 | Matsunaga et al. | 473/346 |

FOREIGN PATENT DOCUMENTS

| | | | | |
|---|---|---|---|---|
| JP | 05192426 | A | * | 8/1993 |
| JP | 06-343722 | A | | 12/1994 |
| JP | 10076031 | A | * | 3/1998 |
| JP | 10155949 | A | * | 6/1998 |
| JP | 11-216203 | A | | 3/1999 |
| JP | 2000-024145 | A | | 1/2000 |
| JP | 2000-317018 | A | | 11/2000 |
| JP | 2001-046559 | A | | 2/2001 |
| JP | 2001-137396 | A | | 5/2001 |
| JP | 2001-187174 | A | | 7/2001 |
| JP | 2001187174 | A | * | 7/2001 |
| JP | 2001-212272 | A | | 8/2001 |
| JP | 2001-353240 | A | | 12/2001 |
| JP | 2002-113134 | A | | 4/2002 |
| JP | 2003-088601 | A | | 3/2003 |
| JP | 2003-159354 | A | | 6/2003 |
| JP | 2004113371 | A | * | 4/2004 |
| JP | 2004141350 | A | * | 5/2004 |
| JP | 2004201879 | A | * | 7/2004 |
| JP | 2004229890 | A | * | 8/2004 |
| JP | 2005-021649 | A | | 1/2005 |
| JP | 2005-160947 | A | | 6/2005 |
| JP | 2005342009 | A | * | 12/2005 |
| JP | 2007-054166 | A | | 3/2007 |
| JP | 3133531 | U | | 6/2007 |

* cited by examiner

GOLF CLUB HEAD

BACKGROUND OF THE INVENTION

1. Field of the Invention

The present invention relates to a metal hollow golf club head and, more particularly, to a large-size golf club head such as a driver.

2. Description of the Related Art

As wood golf club heads such as drivers and fairway woods, hollow golf club heads made of a metal are widely used. Generally, a hollow wood golf club head includes a face portion for hitting a ball therewith, a crown portion forming the top surface portion of the golf club head, a sole portion forming the bottom surface portion of the golf club head, a side portion forming the side surface portion on the toe side, back side, and heel side of the golf club head, and a hosel portion. A shaft is inserted into the hosel portion and fixed thereto with an adhesive or the like.

Aluminum alloys, stainless steel, or titanium alloys are used as a metal for forming the hollow golf club head. Particularly, titanium alloys have been widely used in recent years.

Japanese Patent Laid-Open No. 11-216203 describes a golf club head in which the wall thickness of the sole portion is increased on the front edge side along the face portion. In FIG. 2 of this patent reference, this thick-walled portion is arranged along the overall front edge of the sole portion. In FIG. 4, the thick-walled portions are arranged on the toe and heel sides.

In order to increase the traveling distance of a shot with a metal hollow golf club head, development has been aimed at increasing the restitution of a ball by use of flexure of the face (trampoline effect). However, since the upper limit of the coefficient of restitution was set by the revision of golf rules, a demand has arisen for increasing the traveling distance by another method. Note that in a so-called high restitution golf club head which utilizes the trampoline effect, a long traveling distance can be obtained when hitting a ball at the face center. However, when the hitting point is off the face center (off-center hit), a long traveling distance cannot be obtained.

A golf club head described in Japanese Patent Laid-Open No. 11-216203 mentioned above can achieve a low center of gravity of the head while keeping the balance of the moment of inertia. In FIG. 2 of the patent reference, however, since the thick-walled portion exists in the overall front edge of the sole portion from the toe to the heel, the flexure of the face portion upon hitting a ball is suppressed as a whole, and therefore the traveling distance decreases.

In FIG. 4 of the patent reference, since the thick-walled portions are separately arranged on the sole and heel sides, the flexure of the face portion upon an off-center hit is suppressed, and therefore the traveling distance decreases. In addition, since the flexure of the face portion is large when hitting a ball at the face center, the coefficient of restitution readily exceeds the restriction defined by golf rules.

SUMMARY OF THE INVENTION

It is an object of the present invention to provide a golf club head which provides a long traveling distance on average even when used, for example, by an amateur golfer whose ball hitting point tends to vary.

According to an aspect of the present invention, there is provided a metal hollow golf club head including at least a face portion, sole portion, side portion, and crown portion, comprising a head main body including an opening in the face portion, and a face plate engaged and welded with the opening, wherein the head main body comprises a protruding portion which forms a part of the face portion and protrudes upward from a central portion, in a toe-and-heel direction, of a corner portion between the face portion and the sole portion in the golf club head, and the face plate comprises a recessed portion which extends upward from the lower edge of the face plate and engages with the protruding portion.

According to a preferred embodiment of the present invention, the average wall thickness of the face plate is 2.5 mm to 3.5 mm, the length of the protruding portion in the toe-and-heel direction is 0.5 mm to 20 mm, the maximum height of the protruding portion from a bottom surface of the sole portion is 2.0 mm to 20 mm, and the thickness of the protruding portion is greater than or equal to the thickness of the face plate on both sides of the protruding portion.

According to a preferred embodiment of the present invention, the opening extends to a front edge of the crown portion, and an extending portion extending to the crown portion is integrally provided to the face plate.

According to a preferred embodiment of the present invention, metal forming the golf club head is one of titanium or a titanium alloy.

According to a preferred embodiment of the present invention, the golf club head has a volume of 250 cc to 460 cc.

According to a preferred embodiment of the present invention, a Young's modulus of the face plate is lower than that of the head main body.

Further features of the present invention will become apparent from the following description of exemplary embodiments (with reference to the attached drawings).

DESCRIPTION OF THE EMBODIMENTS

Preferred embodiments of the present invention will now be described in detail in accordance with the accompanying drawings.

Figure 1A:
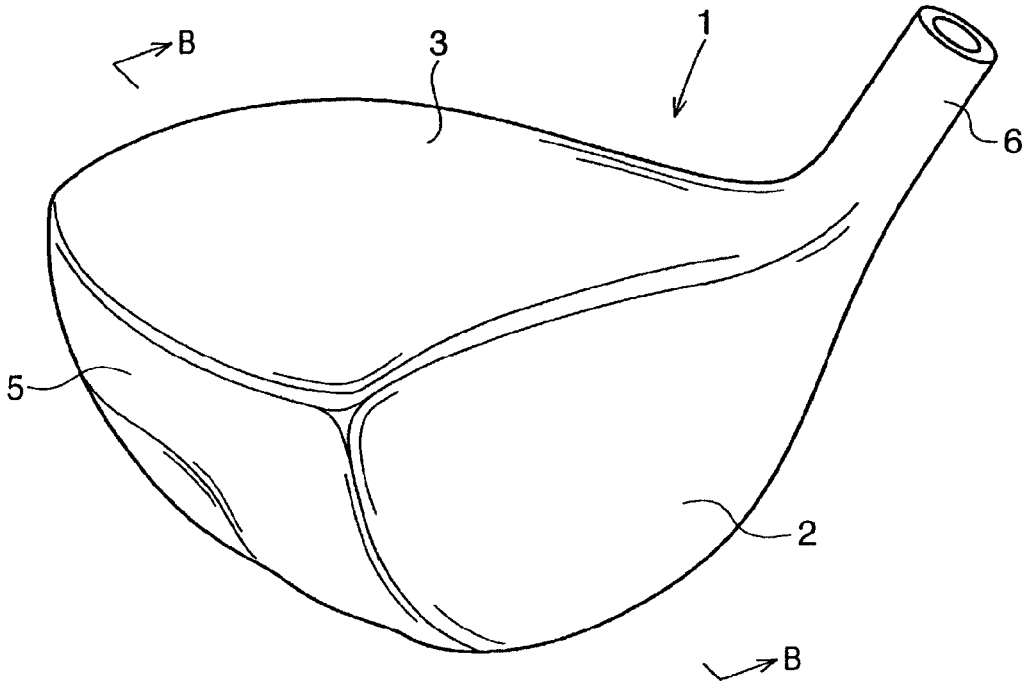
FIG. 1A is a perspective view of a golf club head according to an embodiment of the present invention.
Figure 1B:
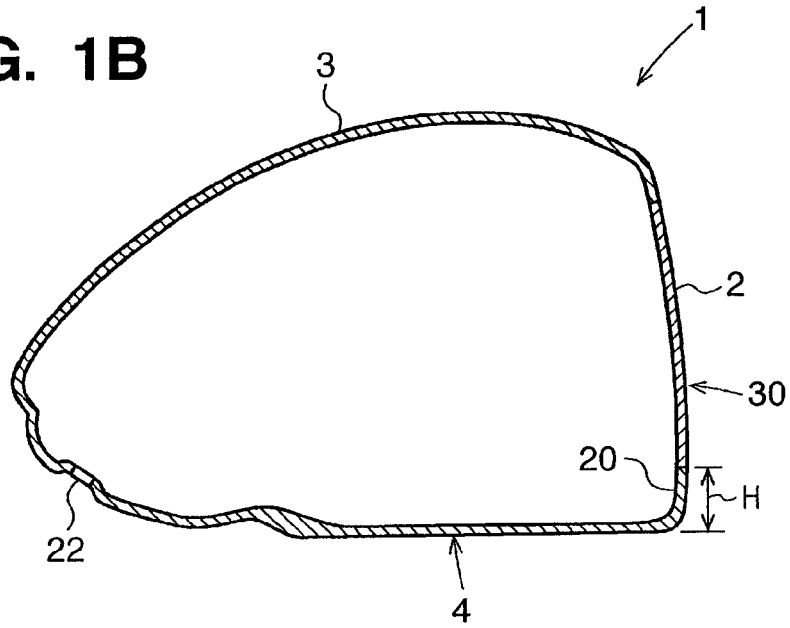
FIG. 1B is a sectional view taken along the line B-B in FIG. 1A.
Figure 2:
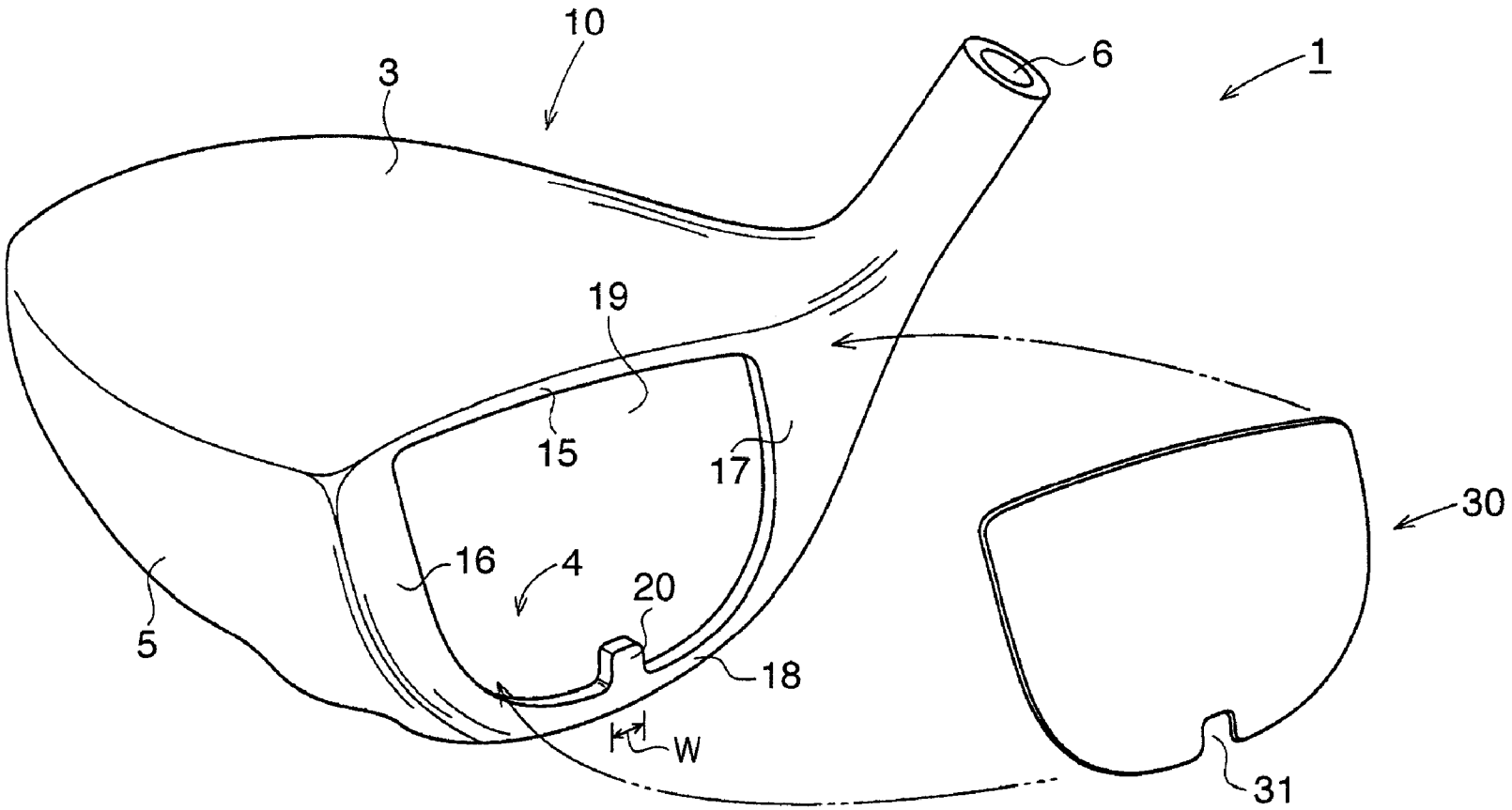
FIG. 2 is an exploded perspective view of the golf club head described above.

FIGS. 1A and 1B are a perspective view and sectional view, respectively, of a golf club head according to an embodiment, and FIG. 2 is an exploded perspective view of the same.

A golf club head 1 includes a face portion 2, a crown portion 3, a sole portion 4, a side portion 5, and a hosel portion 6. The golf club head 1 is formed by integrating a head main body 10 and a face plate 30 by welding such as laser welding or plasma welding. Note that plasma welding or laser welding is high in energy density, and deep in melting-in in comparison with TIG welding. Thus, accurate welding with a good finish can be expected.

As is shown clearly in FIG. 2, the head main body 10 includes the crown portion 3, the sole portion 4, the side portion 5, the hosel portion 6, a top flange 15 which extends from the crown portion 3 toward the face side, a toe flange 16 and a heel flange 17 which extend from the side portion 5 toward the face side, and a bottom flange 18 which extends from the sole portion 4 toward the face side. The major part of the face portion 2 other than these flanges 15 to 18 forms an opening 19. A protruding portion 20 protrudes upward from the central portion of the bottom flange 18 in the toe-and-heel direction.

Reference numeral 22 denotes an attachment portion of a weight (not shown) made of a high specific gravity metal such as tungsten.

The face plate 30 forms a region (face main portion) of the face portion 2 excluding the flanges 15 to 18. In the central portion of the lower edge of the face plate 30 in the toe-and-heel direction, a recessed portion 31 to fit with the protruding portion 20 is formed.

The face plate 30 is fitted in the opening 19 such that the protruding portion 20 and recessed portion 31 engage with each other and the head main body 10 and face plate 30 are integrated by welding, thereby forming the golf club head 1. The hosel portion 6 can be provided to reach the sole portion 4, or can be provided not to reach the sole portion 4. After the welding, various finishing processes of polishing, painting, and the like are performed as needed. Thus, a golf club head product is obtained.

The head main body 10 is a cast, which can be easily manufactured even if the head main body 10 has a complicated shape.

The face plate 30 can be formed by any one of casting, forging, and press molding. The face plate 30 is provided with grooves (score lines) as needed.

In this embodiment, both the head main body 10 and face plate 30 are made of titanium or a titanium alloy.

As the material of the head main body 10, a titanium alloy whose Young's modulus (longitudinal elastic modulus) is about 10,900 kgf/mm$^2$ ($107.8\times10^9$ Pa) or more is used. Examples of such a titanium alloy are an α-β type titanium alloy such as Ti-6Al-4V and Ti-6Al-6V-2Sn and a nearly α type titanium alloy such as Ti-8Al-1Mo-1V. However, Ti-3Al-8V-6Cr-4Mo-4Zr and Ti-22V-4Al, which are β type titanium alloys heat-treated to have a Young's modulus within the above-described range can also be used.

For the face plate 30, either the above-described β type titanium alloy or the α-β type titanium alloy may be used. In order to allow the face plate to flex easily and increase the restitution force, it is preferable to use a titanium alloy whose Young's modulus is lower than that of the head main body 10 preferably by about 500 kgf/mm$^2$ to 4,000 kgf/mm$^2$.

When Ti-6Al-4V as an α-β type titanium alloy is used for the head main body 10, since its Young's modulus is about 10,900 kg/mm, it is preferable to use a β type titanium alloy (Young's modulus of about 10,300 kg/mm or less) for the face plate 30. More specifically, Ti-6Al-4V can be used to form the head main body, and Ti-15Mo-3Cr-3Al-3Sn, Ti-15Mo-5Zr-3Al, or Ti-15Mo-3Al can be used to form the face plate. Since Ti-4.5Al-3V-2Mo-2Fe plastically deforms easily in molding, it is suitable for fabricating the face plate.

Preferable dimensions of the respective parts of the golf club head will be described next.

The present invention is applied particularly effectively to a large-size golf club head whose crown portion flexes easily and, more specifically, to a golf club head (driver) whose head volume is 250 cc or more, preferably 300 cc or more, and more preferably 350 cc or more. The upper limit of the head volume is 460 cc as defined by the golf rules.

Figure 10:
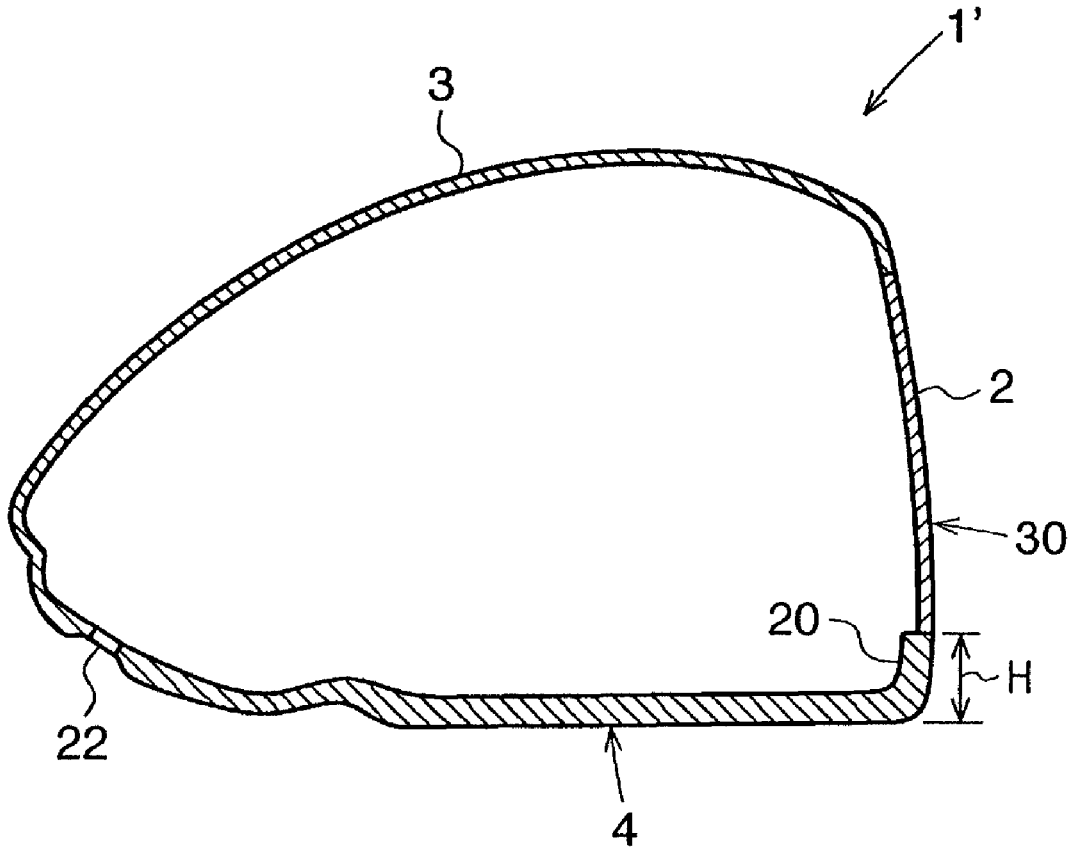
FIG. 10 is a sectional view of a golf club head according to still another embodiment of the present invention.

It is preferable that an average width W of the protruding portion 20 in the toe-and-heel direction be 0.5 mm to 20 mm, and particularly 5 mm to 20 mm. It is preferable that the thickness of the protruding portion 20 be equal to or larger than that of the face plate 30 on the both sides of the protruding portion 20. More specifically, it is preferable that the protruding portion 20 have a thickness of 3 mm or more, and particularly 5 mm to 15 mm. It is preferable that a maximum height H (FIG. 1B) of the protruding portion 20 from the lower surface of the sole portion be 2 mm to 20 mm, and particularly 5 mm to 10 mm. Note that in a golf club head 1' shown in FIG. 10, a protruding portion 20 is formed to be thicker than the connecting portion of the face plate and continue to the back portion.

In addition to an almost square as illustrated, the protruding portion 20 can have various shapes such as a trapezoid, triangle, pentagon, semicircle, and vertically oriented semi-ellipse.

It is preferable that the average thickness of the sole portion 4 be 0.5 mm to 2.0 mm, and particularly 0.7 mm to 2.0 mm. It is preferable that the average thickness of the face portion 2 be 2 mm to 3.5 mm, and particularly 2.7 mm to 3.2 mm. It is preferable that the face portion 2 gradually increase in thickness from the peripheral portion to the central portion.

It is preferable that the average thickness of the crown portion 3 be 0.5 mm to 1.2 mm, and particularly 0.7 mm to 1.0 mm.

In the golf club head 1 with the above-described arrangement, since the protruding portion 20 is provided only in the central portion of the corner portion between the sole portion 4 and face portion 2 in the toe-and-heel direction, it is possible to suppress the flexure near the center of the face portion 2 such that it falls within the range of the coefficient of restitution defined by the golf rules. On the other hand, since no protruding portion 20 is provided in the face portion 2 on the toe and heel sides, the flexure upon hitting a ball becomes large, so that the traveling distance increases in case of an off-center hit. Note that since the coefficient of restitution on the toe and heel sides of the face portion 2 is lower than that of the face center, it does not exceed the limit defined by the golf rules even when the flexure of the face portion 2 becomes large.

From the reasons described above, even an amateur golfer who often hits a ball off the center of face can obtain a long traveling distance on average.

In this embodiment, the wall is thin from the face portion 2 to crown portion 3 and the restitution force is sufficiently high within the range restricted by the golf rules, so that the traveling distance increases. In addition, since the crown portion 3 flexes upon hitting a ball, the traveling distance increases.

Note that when the width W of the protruding portion 20 in the toe-and-heel direction exceeds 20 mm, the restitution force upon hitting a ball off the face center decreases. When the width W is smaller than 0.5 mm, it is difficult to form the protruding portion 20.

When the maximum height H of the protruding portion 20 is excessively large, the restitution force of the face portion 2 decreases. When the maximum height H is excessively small, the coefficient of restitution of the face center becomes excessively high.

Other embodiments of the present invention will be described with reference to FIGS. 3 to 8.

Figure 3:
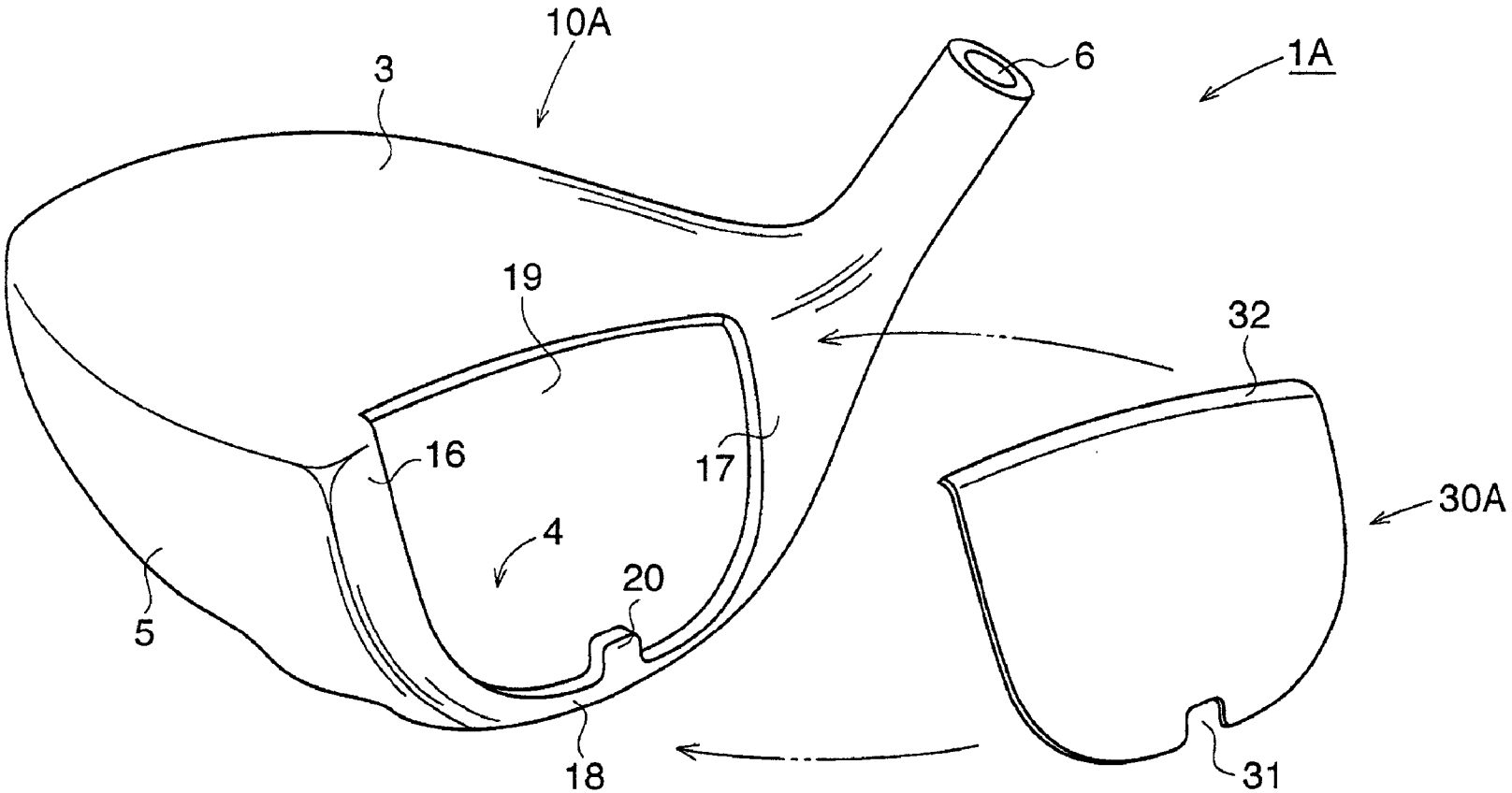
FIG. 3 is an exploded perspective view of a head main body of a golf club head according to another embodiment of the present invention.

In a golf club head 1A according to an embodiment shown in FIG. 3, an opening 19 extends to the front edge of a crown portion 3 of a head main body 10A. A face plate 30A is provided with an extending portion 32 which extends to the front edge of the crown portion 3.

In this manner, when the front edge of the crown portion 3 is integrated with the face plate 30A, the front edge portion of the crown portion 3 can be formed from the same alloy material as the face plate 30A which has a low Young's modulus and flexes easily, so that the traveling distance can increase.

The other components of the golf club head 1A shown in FIG. 3 are the same as in the golf club head 1 shown in FIGS. 1 and 2, and the same reference numerals denote the same portions.

In the embodiment shown in FIG. 3, the width of the extending portion 32 is as relatively narrow as about 2 mm to 10 mm and the major part of the crown portion 3 is formed from the head main body 10. However, the extending portion 32 of the face plate 30 may be formed to be wider than that shown in FIG. 3 and the wider extending portion 32 may form the large area (e.g., major part) of the crown portion.

Figure 4:
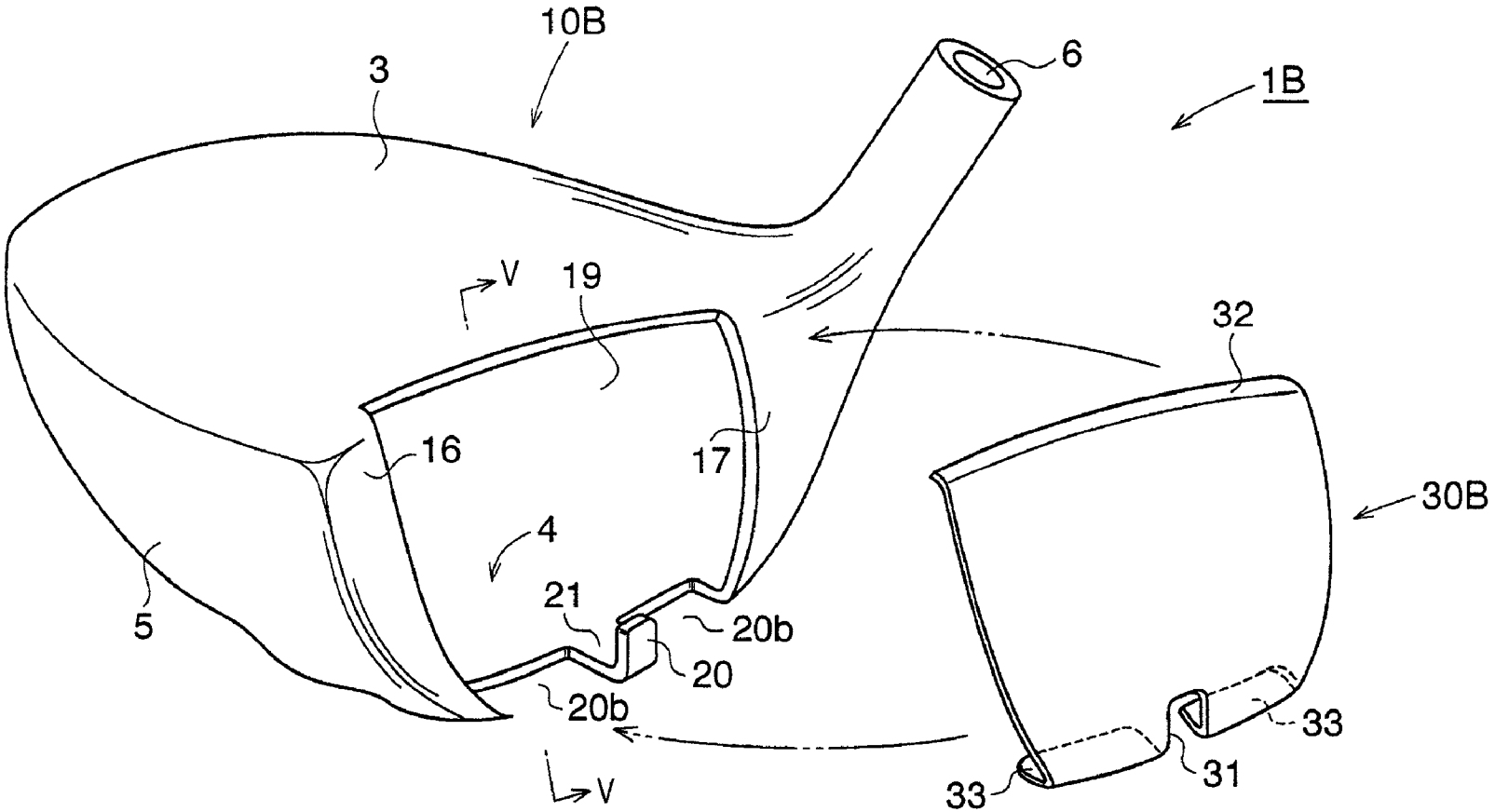
FIG. 4 is an exploded perspective view of a head main body of a golf club head according to still another embodiment of the present invention.
Figure 5:
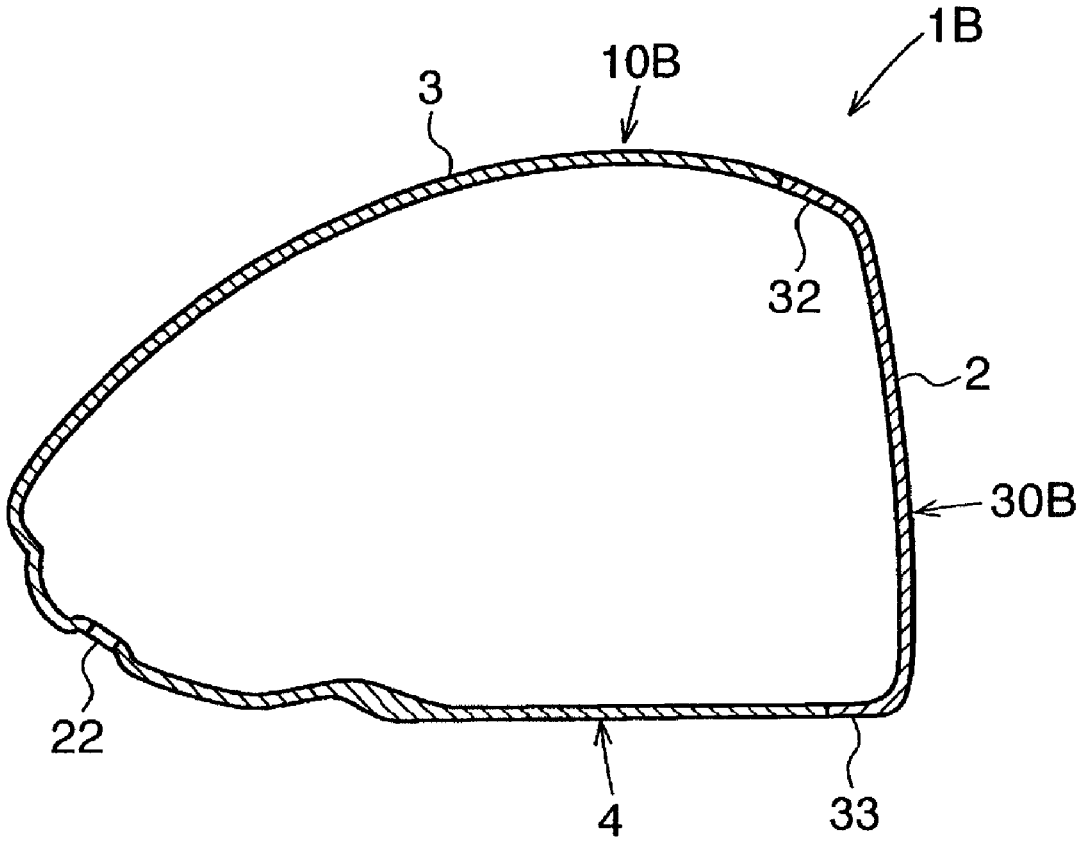
FIG. 5 is a sectional view taken along the line V-V in FIG. 4.

FIG. 4 is an exploded perspective view of a golf club head 1B according to still another embodiment of the present invention, and FIG. 5 is a sectional view of the golf club head 1B taken along the line V-V in FIG. 4.

In a head main body 10B of the golf club head 1B, notches 20*b* are provided on the toe and heel sides of a protruding portion 20 in the front edge of a sole portion 4. Lower extending portions 33 are provided on the toe and heel sides of a recessed portion 31 and extend from the lower edge of a face plate 30B. The lower extending portions 33 are to fit in the respective notches 20*b*. The protruding portion 20 continues to the sole portion 4 via a forward extending portion 21.

The other components in FIG. 4 are the same as in FIG. 3, and the same reference numerals denote the same portions.

In the golf club head 1B in FIG. 4, the sole portion 4 on the front end side and the face plate 30B can be formed from the same flexible material.

Note that in FIG. 4, an opening 19 reaches the front end portion of a crown portion 3, which is formed from an extending portion 32 of the face plate 30B as in FIG. 3. However, no extending portion 32 may be formed as in FIGS. 1 and 2, or the extending portion 32 may form the major part of the crown portion 3 by widening the extending portion 32.

Figure 6:
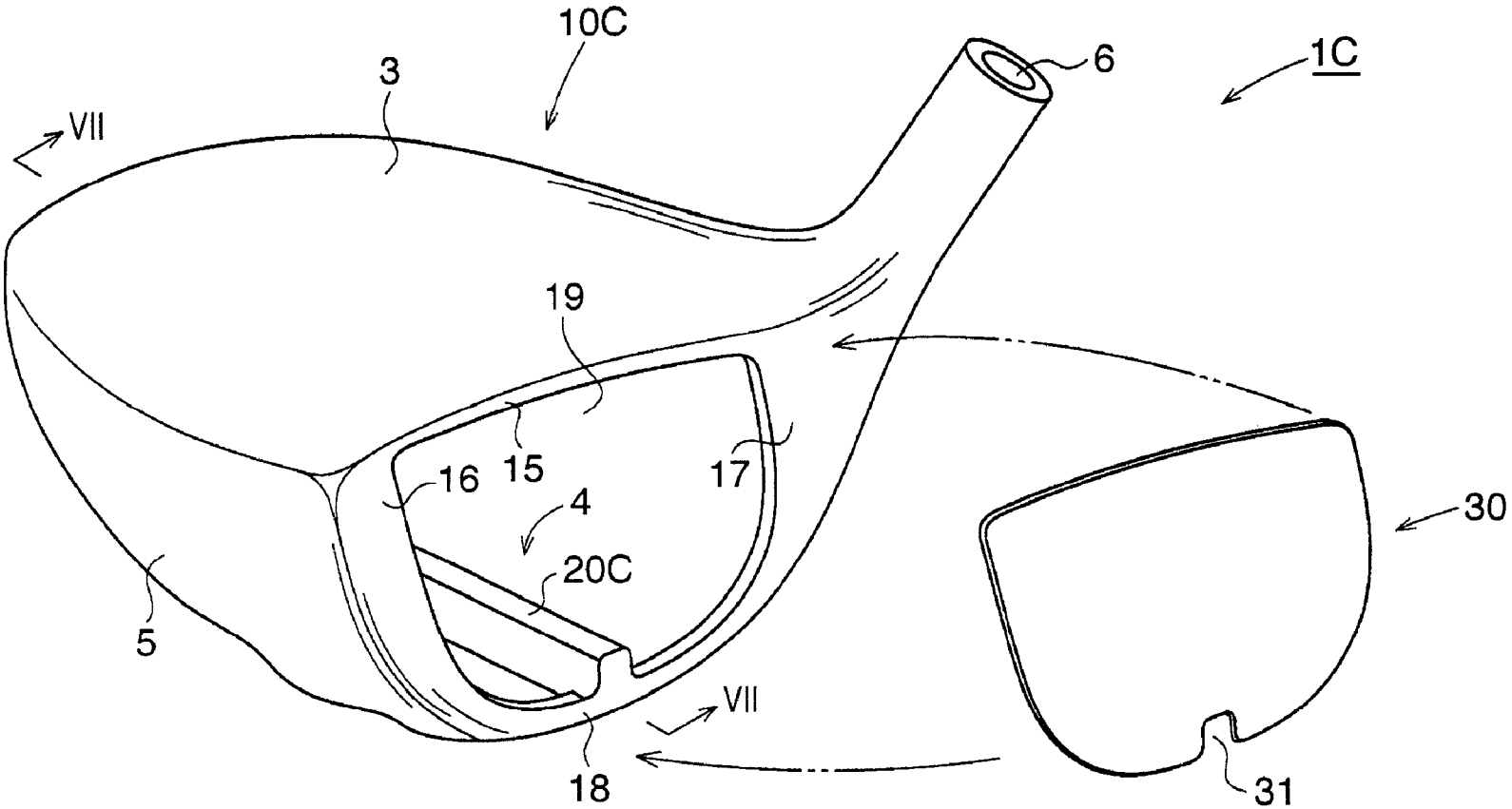
FIG. 6 is an exploded perspective view of a golf club head according to still another embodiment of the present invention.
Figure 7:
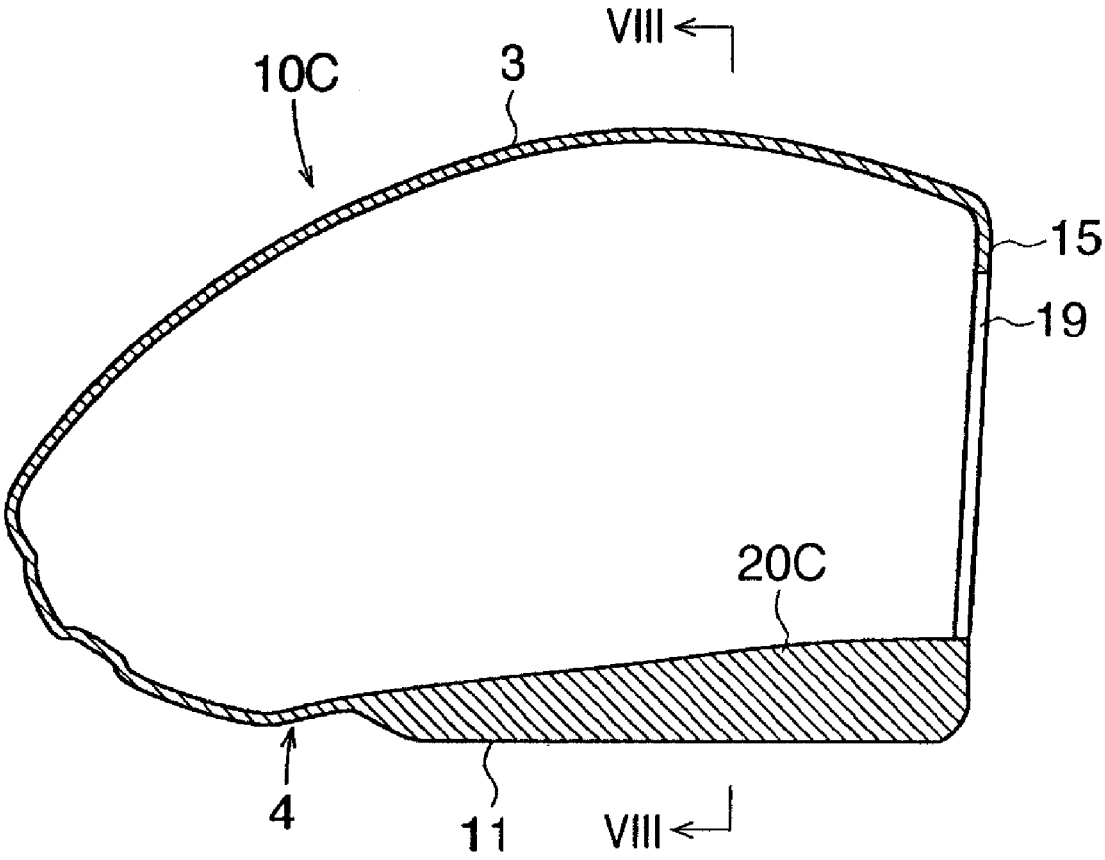
FIG. 7 is a sectional view taken along the line VII-VII in FIG. 6.
Figure 8:
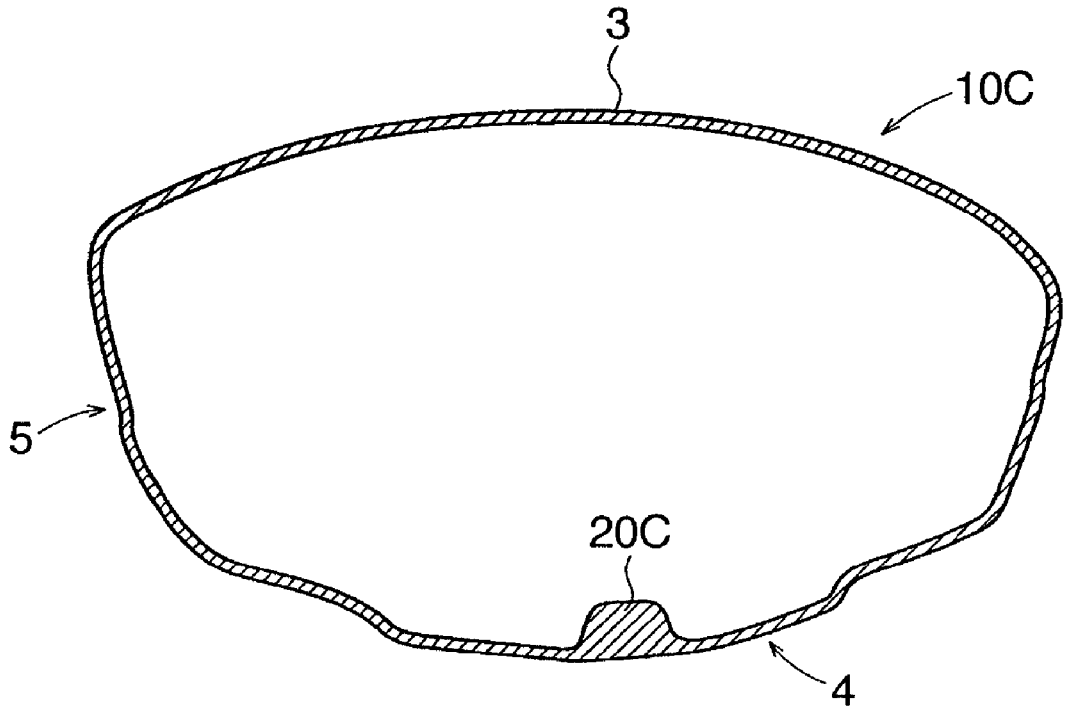
FIG. 8 is a sectional view taken along the line VIII-VIII in FIG. 7.

FIG. 6 is an exploded perspective view of a golf club head 1C according to still another embodiment, FIG. 7 is a sectional view taken along the line VII-VII in FIG. 6, and FIG. 8 is a sectional view taken along the line VIII-VIII in FIG. 7.

In this embodiment, there is provided a protruding portion 20C which extends in the front-and-rear direction in the almost central portion of a sole portion 4 in the toe-and-heel direction.

The front end face of the protruding portion 20C is flush with the front surface of a face plate 30, thereby forming a part of a face portion 3. The rear end of the protruding portion 20C is in the middle of the sole portion 4 in the front-and-rear direction, but the protruding portion 20C may extend to the rearmost part of the sole portion 4.

In this manner, when the protruding portion 20C is provided as a convex line extending in the front-and-rear direction, the bending rigidity of the sole portion 4 can improve. The other components in FIGS. 6 to 8 are the same as in the golf cub head 1 in FIGS. 1 and 2, and the same reference numerals denote the same portions.

Figure 9:
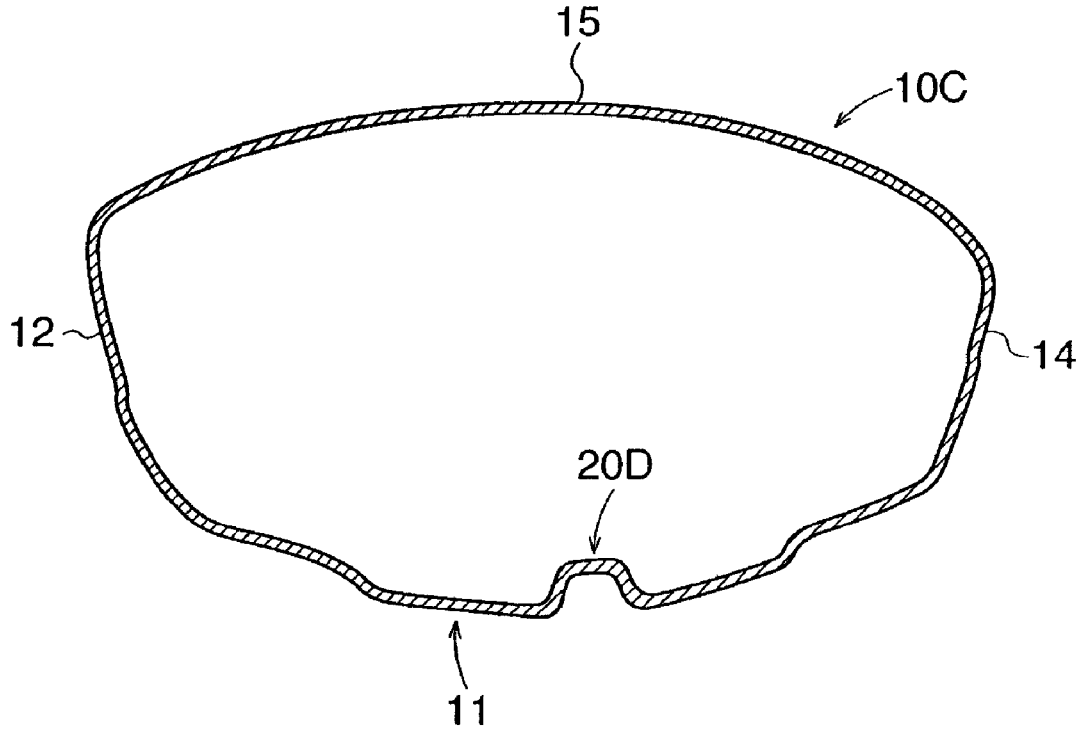
FIG. 9 is a sectional view showing still another embodiment of the present invention and showing the same part as in FIG. 8.

Note that the protruding portion may be solid as shown in FIGS. 7 and 8 or may be formed as a curve portion such as a protruding portion 20D of a head main body 10D shown in FIG. 9. The other components in FIG. 9 are the same as in FIG. 8.

In FIGS. 6 to 9, the crown portion 3 on the front edge side may be formed from the extending portion 32 as in FIGS. 3 and 4, or a part of the sole portion 4 on the front edge side may be formed from the lower extending portion of the face plate as in FIG. 5.

EXAMPLE

For a test, initially, an elliptical face was formed on a computer and an analysis by the finite element method (FEM) was performed. In the analysis by FEM, a reference example with the protruding portion 20 formed in the central lower end portion of the face portion and a reference comparative example without the protruding portion 20 were evaluated.

As the result, for face portions having the same thickness (2.8 mm), the reference comparative example without the protruding portion 20 provided a higher initial speed in both the cases of center and off-center (Y indicates a case in which the hitting point was shifted by 10 mm or 20 mm in the lateral direction, and Z indicates a case in which the hitting point is shifted by 5 mm in the lengthwise direction).

When the wall thickness of the face of the reference example was set to 2.6 mm, it provided the same initial speed as the reference comparative example (face wall thickness: 2.8 mm) at the off-center position (Y=20 mm). When the wall thickness of the face of the reference example was set to 2.4 mm, it provided the same initial speed upon a center hit as the reference comparative example having a face wall thickness of 2.8 mm, and it provided the highest initial speed for an off-center hit. It is assumed that these results were obtained due to the following reason. That is, since the flexure at the position where the face flexes the most was suppressed by providing the protruding portion, the initial speed upon the center hit decreased. Accordingly, it is assumed that the face with a thin wall has a strength almost as large as that of a face with the wall thickness of 2.8 mm.

Figure 11A:
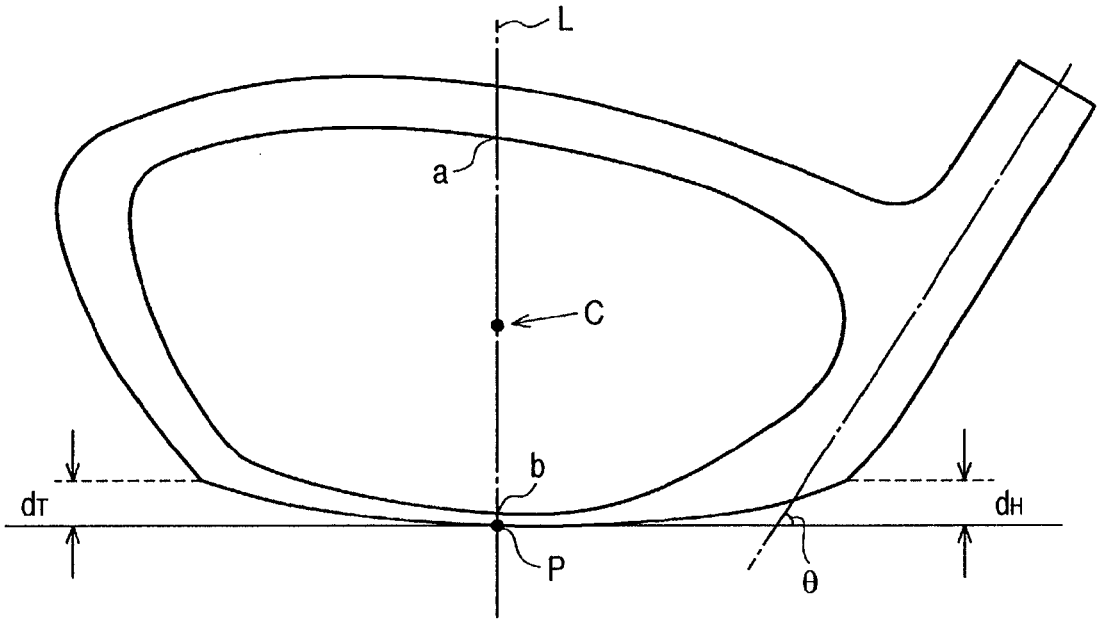
FIGS. 11A and 11B are views for explaining the definition of a face center.
Figure 11B:
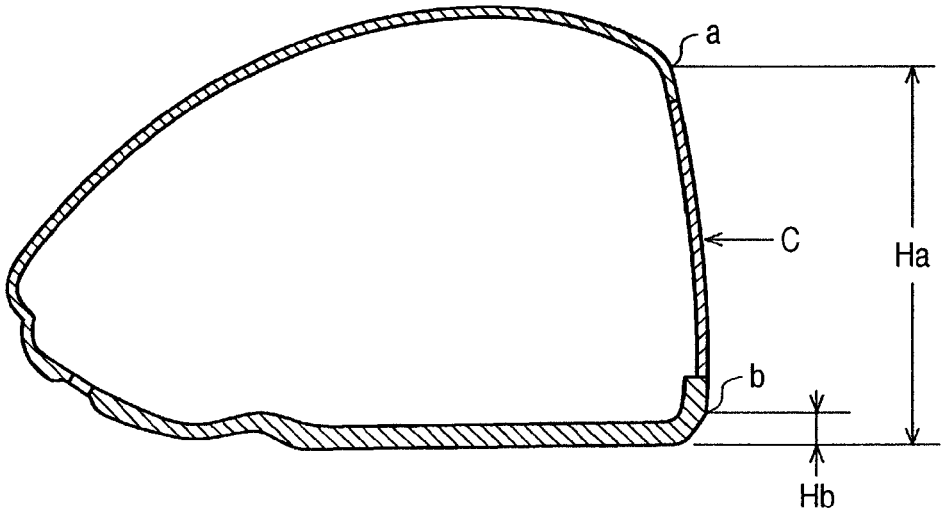

The definition of the face center will be described with reference to FIGS. 11A and 11B. FIG. 11A is a front view of a golf club head when viewed from the face side, and FIG. 11B is a longitudinal sectional view in the front-and-rear direction taken along the line extending through the face center. As shown in FIG. 11A, the head is set in a measuring device such that gaps $d_T$ and $d_H$ at both ends of the sole on the toe and heel sides are equal. A shaft angle θ at this time is the lie angle. Next, a contact point P between the sole (S) and the ground line (G) is defined as a face center line L in the horizontal direction, and the slice angle is set to 0°. At this time, the highest position in the longitudinal section in the front-and-rear direction including the face center line L on the face is a point a, and the lowest point is a point b. A face center C is the middle point between the points a and b on the face.

If Ha and Hb represent the height of the point a and that of the point b, respectively, the height of the point C is given by [(Ha−Hb)/2+Hb].

Example 1

A golf club head having a volume of 460 cc was fabricated according to the arrangement shown in FIGS. 1 and 2. The head main body 10 was made from an α-β type titanium alloy (Ti-6Al-4V) formed by investment casting. The face plate 30 was fabricated by forging a β type titanium alloy.

Each of the flanges 15 to 18 of the head main body 10 had a thickness of 2.5 mm. The crown portion was 0.6 mm in thickness; the side portion, 0.7 mm; and the sole portion (excluding the protruding portion), 0.9 mm. The wall thickness of the face plate 30 was 2.5 mm in the peripheral portion and gradually increased toward the central portion wherein the thickness was 3.5 mm. The dimension of the protruding portion 20 was set to W=20 mm, H=10 mm, and thickness=10 mm.

A swing robot available from Miyamae was used and the head speed was set to 45 m/s. The initial ball speed, launch angle, back spin rate, and traveling distance (carry) were measured for the case of hitting a ball at face center and the case of hitting a ball at a position shifted to the toe side by 15 mm.

The results are shown in Table 1.

Example 2

Measurement was performed for Example 2 which had the same arrangement as Example 1 except that the dimension W of the protruding portion 20 in the toe-and-heel direction was set to 0.5 mm and the height H was set to 10 mm. The results are shown in Table 1.

Example 3

Measurement was performed for Example 3 which had the same arrangement as Example 1 except that the dimension W of the protruding portion 20 in the toe-and-heel direction was set to 20 mm and the height H was set to 5 mm. The results are shown in Table 1.

Example 4

Measurement was performed for Example 4 which had the same arrangement as Example 1 except that the dimension W of the protruding portion 20 in the toe-and-heel direction was set to 20 mm and the height H was set to 20 mm. The results are shown in Table 1.

Comparative Example 1

Measurement was performed for Comparative Example 1 which had the same arrangement as Example 1 except that the dimension W of the protruding portion 20 in the toe-and-heel direction was set to 40 mm and the height H was set to 10 mm. The results are shown in Table 1.

Comparative Example 2

Measurement was performed for Comparative Example 2 which had the same arrangement as Example 1 except that the dimension W of the protruding portion 20 in the toe-and-heel direction was set to 20 mm and the height H was set to 30 mm. The results are shown in Table 1.

Comparative Example 3

Measurement was performed for Comparative Example 3 which had the same arrangement as Example 1 except that no protruding portion was provided, i.e., W=0 mm. The results are shown in Table 1.

TABLE 1

| | | | | Initial Speed (m/s) | Launch Angle (°) | Spin (rpm) | Traveling distance (m) |
|---|---|---|---|---|---|---|---|
| Example 1 | W = 20 mm | H = 10 mm | center | 62 | 9.5 | 2350 | 208.3 |
| | | | toe 15 mm | 61.3 | 9.3 | 2580 | 203.7 |
| Example 2 | W = 0.5 mm | H = 10 mm | center | 62.2 | 9.4 | 2320 | 208.8 |
| | | | toe 15 mm | 61.7 | 9.3 | 2410 | 205.8 |
| Example 3 | W = 20 mm | H = 5 mm | center | 62.4 | 9.3 | 2310 | 209.3 |
| | | | toe 15 mm | 61.6 | 9.2 | 2570 | 205.2 |
| Example 4 | W = 20 mm | H = 20 mm | center | 61.5 | 9.8 | 2340 | 207.1 |
| | | | toe 15 mm | 60.6 | 9.6 | 2540 | 201.5 |
| Comparative Example 1 | W = 40 mm | H = 10 mm | center | 61.8 | 9.5 | 2380 | 207.4 |
| | | | toe 15 mm | 60.5 | 9.3 | 2590 | 200.9 |
| Comparative Example 2 | W = 0 mm | H = 0 mm | center | 62.7 | 9.2 | 2300 | 210.3 |
| | | | toe 15 mm | 61.5 | 9.1 | 2480 | 204.7 |
| Comparative Example 3 | W = 20 mm | H = 30 mm | center | 60.5 | 9.8 | 2400 | 202.4 |
| | | | toe 15 mm | 60 | 9.7 | 2570 | 199.8 |

Referring to Table 1, the examples according to the present invention provide long traveling distances even when balls are hit off the face center. In Examples 1 to 4, the difference in initial ball speed between the case a hitting point at the center and the case of a hitting point shifted from the center to the toe side by 15 mm (toe 15 mm) is not more than 1 m/s. In Comparative Examples 1 and 2, the difference in initial ball speed is not less than 1 m/s. Comparative Example 3 is not preferable because the restitution force at the center excessively decreases when the thick-walled portion is too high. Note that in Comparative Example 3, the difference in initial ball speed is not more than 1 m/s even in the case of an off-center hit (toe 15 mm).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-54397, filed Mar. 5, 2007, which is hereby incorporated by reference herein in its entirety.

What is claimed is:

1. A metal hollow golf club head including at least a face portion, sole portion, side portion, crown portion, a toe side, and a heel side, comprising:

a head main body including an opening in the face portion; and a face plate engaged and welded with the opening;

wherein said head main body comprises a protruding portion which forms a part of the face portion and protrudes upward from a central portion, in a toe-and-heel direction, of a corner portion between the face portion and the sole portion in the golf club head, and said face plate comprises a recessed portion which extends upward from the lower ledge of said face plate and engages with the protruding portion, wherein there are no protruding portions in the face portion on the toe and heel sides so that a flexure of the face plate is not decreased on the toe and heel sides.

2. The head according to claim 1, wherein an average wall thickness of said face plate is 2.5 mm to 3.5 mm, a length of the protruding portion in the toe-and-heel direction is 0.5 mm to 20 mm, a maximum height of the protruding portion from a bottom surface of the sole portion is 2.0 mm to 20 mm, and a thickness of the protruding portion is not less than a thickness of said face plate on both sides of the protruding portion.

3. The head according to claim 1, wherein the opening extends to a front edge of the crown portion, and an extending portion extending to the crown portion is integrally provided to said face plate.

4. The head according to claim 1, wherein a metal forming the golf club head is one of titanium and a titanium alloy.

5. The head according to claim 1, wherein the golf club head has a volume of 250 cc to 460 cc.

6. The head according to claim 1, wherein a Young's modulus of said face plate is lower than that of said head main body.

7. The head according to claim 1, wherein the corner portion between the face portion and the sole portion in the golf club head has a center in a toe-and heel direction, and the protruding portion is in the center.

8. The head according to claim 1, wherein a thickness of the protruding portion is not less than a thickness of said face plate.

9. The head according to claim 1, wherein a Young's modulus of said face plate is lower than that of said head main body, and a thickness of the protruding portion is not less than a thickness of said face plate.

* * * * *